US006888510B2

(12) United States Patent
Jo et al.

(10) Patent No.: US 6,888,510 B2
(45) Date of Patent: May 3, 2005

(54) COMPACT, LOW PROFILE, CIRCULAR POLARIZATION CUBIC ANTENNA

(75) Inventors: Young-Min Jo, Rockledge, FL (US); Michael H. Thursby, Palm Bay, FL (US); Frank M. Caimi, Vero Beach, FL (US); Kerry L. Greer, Melbourne Beach, FL (US); Mark D. Nelson, Satellite Beach, FL (US); John C. Farrar, Indialantic, FL (US)

(73) Assignee: SkyCross, Inc., Melbourne, FL (US)

( * ) Notice: Subject to any disclaimer, the term of this patent is extended or adjusted under 35 U.S.C. 154(b) by 22 days.

(21) Appl. No.: 10/643,760

(22) Filed: Aug. 19, 2003

(65) Prior Publication Data

US 2004/0090389 A1 May 13, 2004

Related U.S. Application Data

(60) Provisional application No. 60/404,941, filed on Aug. 19, 2002.

(51) Int. Cl.[7] ..... H01Q 21/26
(52) U.S. Cl. ..... 343/797; 343/700 MS
(58) Field of Search ..... 343/700 MS, 744, 343/797

(56) References Cited

U.S. PATENT DOCUMENTS 5,200,756 A * 4/1993 Feller ..... 343/700 MS
5,293,176 A 3/1994 Elliot ..... 343/797
5,680,144 A 10/1997 Sanad ..... 343/700 MS
5,719,586 A 2/1998 Tuttle ..... 343/726
5,784,032 A * 7/1998 Johnston et al. ..... 343/702
5,923,296 A 7/1999 Sanzgiri et al. ..... 343/700 MS
5,926,137 A 7/1999 Nealy ..... 343/700 MS
5,940,036 A * 8/1999 Oliver et al. ..... 343/700 MS
6,023,244 A 2/2000 Snygg et al. ..... 343/700 MS
6,057,802 A 5/2000 Nealy ..... 343/700 MS
6,252,550 B1 6/2001 Vernon ..... 343/700 MS
6,259,369 B1 7/2001 Monico ..... 340/572.8
6,300,906 B1 10/2001 Rawnick et al. ..... 343/700 MS
6,320,544 B1 11/2001 Korisch et al. ..... 343/700 MS
6,323,814 B1 * 11/2001 Apostolos ..... 343/744
6,359,599 B2 3/2002 Apostolos ..... 343/895
6,373,446 B2 4/2002 Apostolos ..... 343/797
6,480,158 B2 11/2002 Apostolos ..... 343/700 MS
6,492,953 B2 * 12/2002 Apostolos ..... 343/744
6,650,291 B1 * 11/2003 West et al. ..... 342/371

* cited by examiner

*Primary Examiner*—Shih-Chao Chen
(74) *Attorney, Agent, or Firm*—John L. DeAngelis, Jr.; Beusse Brownlee Wolter Mora & Maire, P.A.

(57) ABSTRACT

An antenna providing circular polarization for received and transmitted signals. The antenna comprises a vertical conductive surfaces oriented to form a closed structure and horizontal conductive surfaces forming a top face of the closed structure. Connection of selected vertical panels to a feed and ground, causes current flow in the vertical and horizontal surfaces that results in a circular polarized signal.

32 Claims, 9 Drawing Sheets

COMPACT, LOW PROFILE, CIRCULAR POLARIZATION CUBIC ANTENNA

This application claims the benefit of the provisional application filed on Aug. 19, 2002, assigned application Ser. No. 60/404,941 and entitled, Compact Low Profile Circular Polarization Antenna.

FIELD OF THE INVENTION

The present invention relates generally to antennas for transmitting and receiving radio frequency signals, and more specifically to such antennas providing a circularly polarized signal at several operating frequencies.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity and the radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wavelength and half wavelength antennas are the most commonly used.

The burgeoning growth of wireless communications devices and systems has created a substantial need for physically smaller, less obtrusive, and more efficient antennas that are capable of wide bandwidth operation, multiple frequency-band operation, and/or operation in multiple modes (i.e., selectable radiation patterns or selectable signal polarizations). Smaller packaging of state-of-the-art communications devices may not provide sufficient space for the conventional quarter and half wavelength antenna elements. Thus physically smaller antennas operating in the frequency bands of interest and providing the other desirable antenna operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=$(\beta R)^2+2\beta R$, where R is the radius of the sphere containing the antenna and $\beta$ is the propagation factor. Increased gain thus requires a physically larger antenna, while communications device manufacturers and users continue to demand physically smaller antennas. As a further constraint, to simplify the system design and strive for minimum cost, equipment designers and system operators prefer to utilize antennas capable of efficient multi-frequency and/or wide bandwidth operation, allowing the communications device to access various wireless services operating within different frequency bands from a single antenna. Finally, gain is limited by the known relationship between the antenna resonant frequency and the effective antenna length (expressed in wavelengths). That is, the antenna gain is constant for all quarter wavelength antennas of a specific geometry i.e., at the operating frequency where the effective electrical antenna length is a quarter of the operating frequency wavelength.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

One basic antenna commonly used in many applications today is the half-wavelength dipole antenna. The radiation pattern is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical gain is about 2.15 dBi.

The quarter-wavelength monopole antenna placed above a ground plane is derived from a half-wavelength dipole. The physical antenna length is a quarter-wavelength, but with the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. However, conventional loop antennas are too large for handset applications and do not provide multi-band operation. As the loop length increases (i.e., approaching one free-space wavelength), the maximum of the field pattern shifts from the plane of the loop to the axis of the loop. Placing the loop antenna above a ground plane generally increases its directivity.

Printed or microstrip antennas are constructed using the principles of printed circuit board techniques, where a top metallization layer overlying a dielectric substrate serves as the radiating element. These antennas are popular because of their low profile, the ease with which they can be fabricated and a relatively low fabrication cost. One such antenna is the patch antenna, comprising in stacked relation, a ground plane, a dielectric substrate, and a radiating element overlying the top substrate surface. The patch antenna provides directional hemispherical coverage with a gain of approximately 3 dBi. Although small compared to a quarter or half wavelength antenna, the patch antenna has a relatively poor radiation efficiency, i.e., the resistive return losses are relatively high within its operational bandwidth. Also, disadvantageously, the patch antenna exhibits a relatively narrow bandwidth. Multiple patch antennas can be stacked in parallel planes or spaced-apart in a single plane to synthesize a desired antenna radiation pattern that may not be achievable with a single patch antenna.

Given the advantageous performance of quarter and half wavelength antennas, conventional antennas are typically constructed so that the antenna length is on the order of a quarter wavelength of the radiating frequency, and the antenna is operated over a ground plane. These dimensions allow the antenna to be easily excited and operated at or near a resonant frequency, limiting the energy dissipated in resistive losses and maximizing the transmitted energy. But, as the operational frequency increases/decreases, the operational wavelength correspondingly decreases/increases.

Since the antenna is designed to present a dimension that is a quarter or half wavelength at the operational frequency, when the operational frequency changes, the antenna is no longer operating at a resonant condition and antenna performance deteriorates.

As can be inferred from the above discussion of various antenna designs, each exhibits know advantages and disadvantages. The dipole antenna has a reasonably wide bandwidth and a relatively high antenna efficiency (or gain). The major drawback of the dipole, when considered for use in personal wireless communications devices, is its size. At an operational frequency of 900 MHz, the half-wave dipole comprises a linear radiator of about six inches in length. Clearly it is difficult to locate such an antenna in the small space envelope associated with today's handheld devices. By comparison, the patch antenna or the loop antenna over a ground plane present a lower profile resonant device than the dipole, but as discussed above, operate over a narrower bandwidth with a highly directional radiation pattern.

As discussed above, multi-band or wide bandwidth antenna operation is especially desirable for use with various personal or handheld communications devices. One approach to producing an antenna having multi-band capability is to design a single structure (such as a loop antenna) and rely upon the higher-order resonant frequencies of the loop structure to obtain a radiation capability in a higher frequency band. Another method employed to obtain multi-band performance uses two separate antennas, placed in proximity, with coupled inputs or feeds according to methods well known in the art. Thus each of the two separate antennas resonates at a predictable frequency to provide operation in at least two frequency bands. Notwithstanding these techniques, it remains difficult to realize an efficient antenna or antenna system that satisfies the multiband/wide bandwidth operational features in a relatively small physical volume.

The global positioning system (GPS) comprises a constellation of satellites in orbit about the earth from which geolocation information can be obtained for any location on the earth's surface. The GPS satellite signals from which the position information is derivable have a center frequency of 1.75 GHz and are circularly polarized. Of course, users and manufacturers desire minimal size antennas capable of receiving the GPS signals.

Two types of antennas that are known to provide a circularly polarized signal are the circular dipole antenna and the helix antenna. A circular dipole is illustrated in FIG. 1 as comprising four perpendicularly disposed dipole elements 2A, 2B, 2C and 2D, where elements 2A and 2B are connected to ground, element 2C is connected to a 90° or 0° phase shifter 4, and element 2D is connected to a 0° or 90° phase shifter 5 as shown. Each phase shifter 4 and 5 is connected to a feed 6 and 7, respectively. Circular polarization is achieved by feeding the elements 2C and 2D with signals having a phase difference of an odd multiple of $\pi/2$.

Each of the elements 2A, 2B, 2C, and 2D is a half wavelength in length at the operating frequency. Thus for operation at 1 GHz, each element is about 15 cm long, which is clearly too long for handset and mobile applications. The phase shifters 4 and 5 (embodied as a hybrid component or an electronic phase shifter) supply signals with the proper phase relationship, but also represent extra components for the wireless device, which in turn entails an expense and a space allotment.

A helical antenna 8 of Figure also provides a circularly polarized signal. However the antenna size, especially the height can be problematic for handset and mobile communications devices. To create a circularly polarized signal, the antenna must operate in the axial mode, where $\pi D/\lambda=1$, $S=\lambda/4$ and $N>3$. N is the number of turns in the helical antenna 8. D and S, which are indicated on FIG. 2, are the diameter of the helix and the spacing between adjacent turns. The antenna height is L=NS. Therefore, to produce a circularly polarized beam the diameter $D=\lambda/\pi=0.32\lambda$ and the height $H>3\lambda/4=0.75\lambda$.

BRIEF SUMMARY OF THE INVENTION

An antenna comprising a plurality of vertical conductive surfaces each having a top edge and oriented to form side surfaces of an upright structure with a first gap defined between adjacent vertical surfaces. The antenna further comprising a plurality of horizontal conductive surfaces forming a top surface of the upright structure and oriented to form a second gap between adjacent horizontal surfaces. Third gaps are formed between a top edge of each one of the plurality of vertical surfaces and an adjacent one of the plurality of horizontal surfaces. A first conductive bridge electrically connects a first and a second horizontal surface of the plurality of horizontal surfaces, and a second conductive bridge electrically connects a third and a fourth horizontal surface of the plurality of horizontal surfaces. A first vertical surface of the plurality of vertical surfaces connects to a signal feed for the antenna, and a second and a third vertical surface of the plurality of vertical surfaces connects to ground.

BRIEF DESCRIPTION OF THE DRAWINGS

The features of the antenna constructed according to the teachings of the present invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
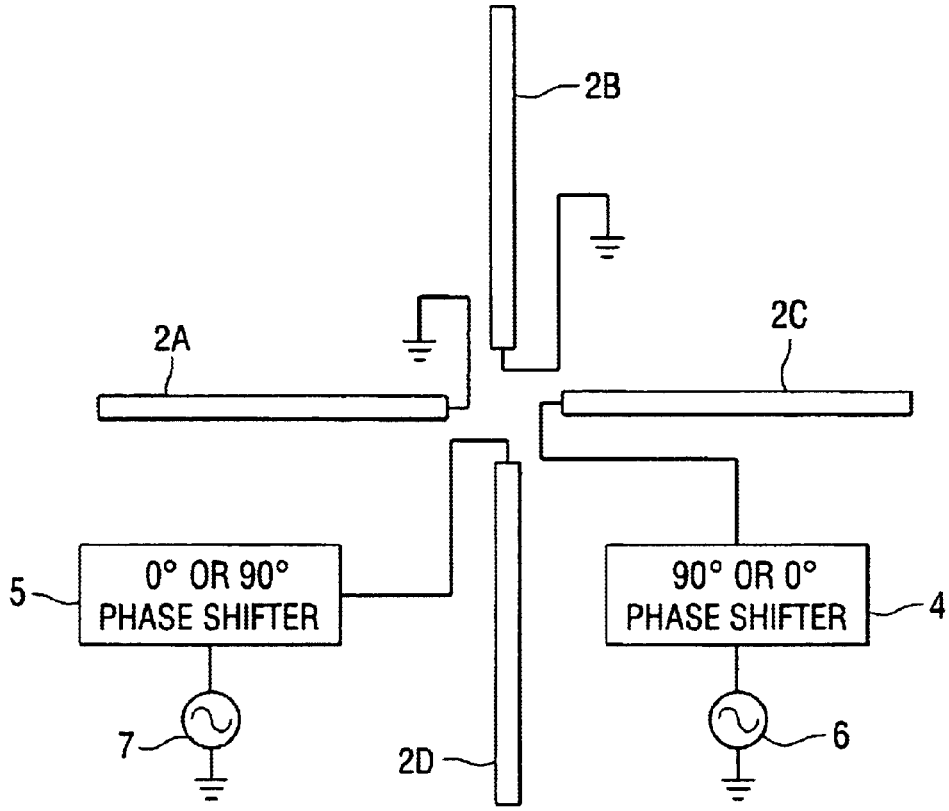
FIG. 1 PRIOR ART
FIGS. 1 and 2 illustrate two prior art antennas providing a circularly polarized signal.
Figure 2:
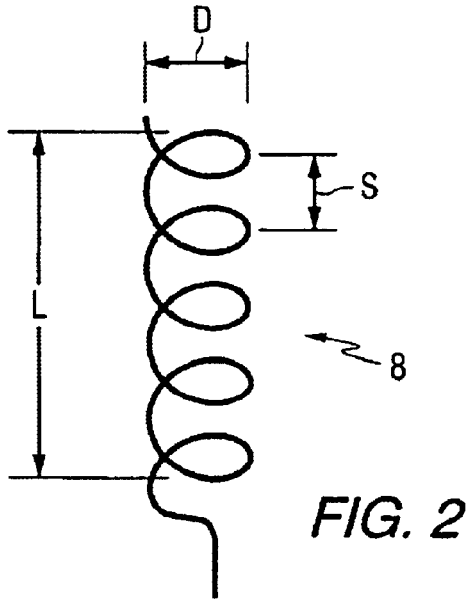

Before describing in detail the particular wideband antenna in accordance with the present invention, it should be observed that the present invention resides primarily in a novel combination of elements. Accordingly, the elements have been represented by conventional elements in the drawings, showing only those specific details that are pertinent to the present invention, so as not to obscure the disclosure with structural details that will be readily apparent to those skilled in the art having the benefit of the description herein.

Figure 3:
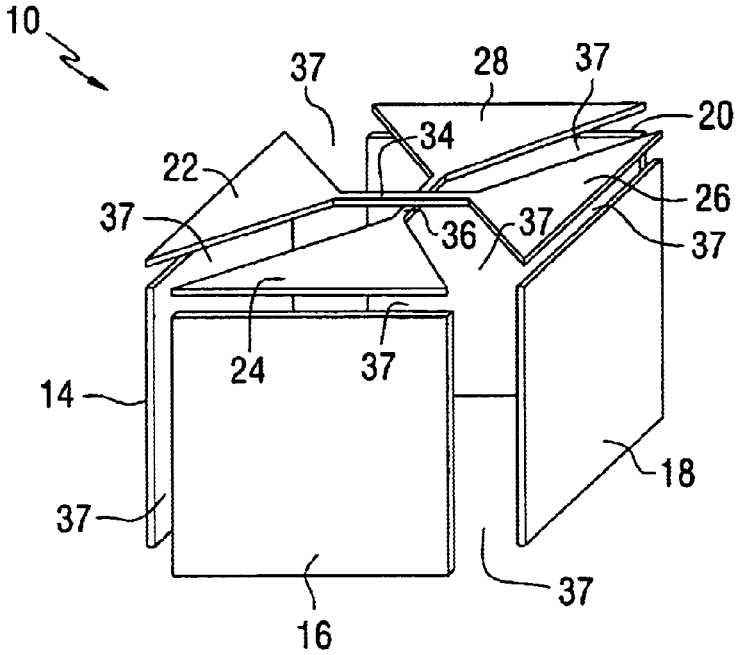
FIGS. 3 and 4 illustrate a perspective and a top view of an antenna constructed according to one embodiment of the present invention.

An antenna 10 constructed according to the teachings of the present invention is illustrated in FIG. 3, comprising four vertical panels 14, 16, 18 and 20, and four top panels 22, 24, 26 and 28. The antenna 10 further comprises two electrically conductive bridges connecting opposingly directed ones of the top panels. That is, a bridge 34 electrically connects the top panels 22 and 26. A bridge 36 connects the top panels 24 and 28. As illustrated in FIG. 3, each of the panels 14, 16, 18, 20, 22, 24, 26 and 28 is physically separated from the adjacent panels. Only the panels 22 and 26 and the panels 24 and 28 are electrically connected by their respective conductive bridge. Gaps 37 are formed between adjacent vertical panels, between adjacent horizontal panels, and between each pair comprising a vertical panel and a horizontal panel. The shape of the antenna 10 is dependent on the shape of the various vertical and top panels. For example, if each vertical panel comprises a square, the shape is substantially cubic. If each vertical panel comprises a rectangular, the shape is substantially a rectangular polyhedron. In any case, the vertical panels form an upright structure and the top panels form a top surface of that upright structure. In the embodiment illustrated in FIG. 3 each one of the four top panels comprises a triangle, having a base and an apex according to common nomenclature.

One of the vertical panels, for example the vertical panel 16, is connected to a signal feed and two of the other three vertical panels are connected to ground. As will be explained later, a left-hand circularly polarized signal and a right-hand circularly polarized signal are obtained by different feed and ground connections for the four vertical panels. For example, to obtain a left-hand circularly polarized signal, the vertical pattern 16 is connected to the signal feed and the vertical panels 14 and 20 are connected to ground. An antenna ground plane (not shown in FIG. 3) completes the circuit path between the vertical panel that serves as the antenna feed and the grounded vertical panels.

Figure 4:
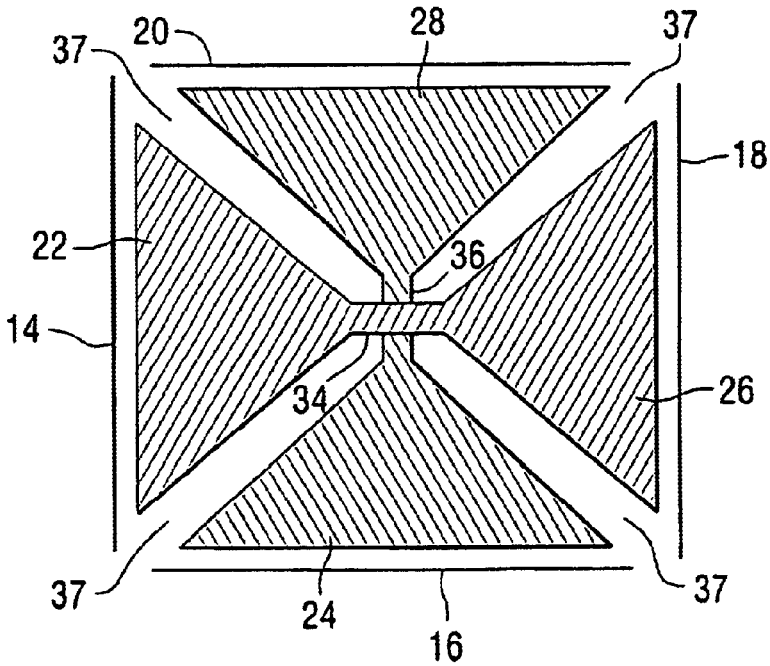

In one embodiment, the top panels 24 and 28 and the conductive bridge 36 can be formed from a first sheet of conductive material. Similarly, the top panels 22 and 24 and the conductive bridge 34 can be formed from a second sheet of conductive material. The first and second conductive sheets are disposed one above the other with a dielectric material therebetween. See FIG. 4 where the shading markings indicate those elements formed on the same conductive sheet overlying a dielectric substrate.

In another embodiment, the four top panels 22, 24, 26 and 28 and one of the conductive bridges 34 and 36 are formed by masking, patterning and etching of a conductive material disposed on a dielectric substrate. The other of the conductive bridges 34 and 36 comprises a separate element that must be conductively affixed to connect its respective top panels.

Figure 5:
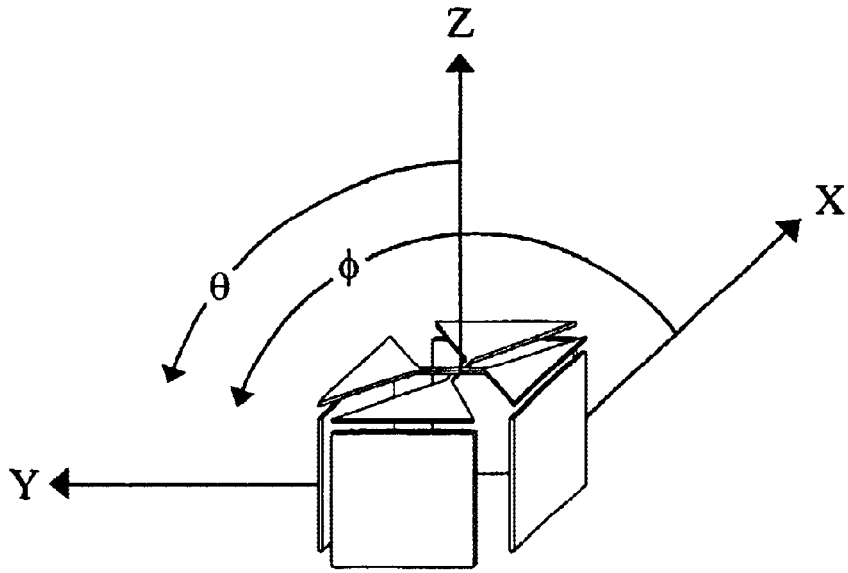
FIG. 5 depicts a three-dimensional coordinate system.

FIG. 5 illustrates a three-dimensional Cartesian coordinate system, with the antenna 10 superimposed thereon, for illustrating the orientation for the left and right-hand circularly polarized antenna signals and the far field mathematical expressions discussed below.

Figure 6:
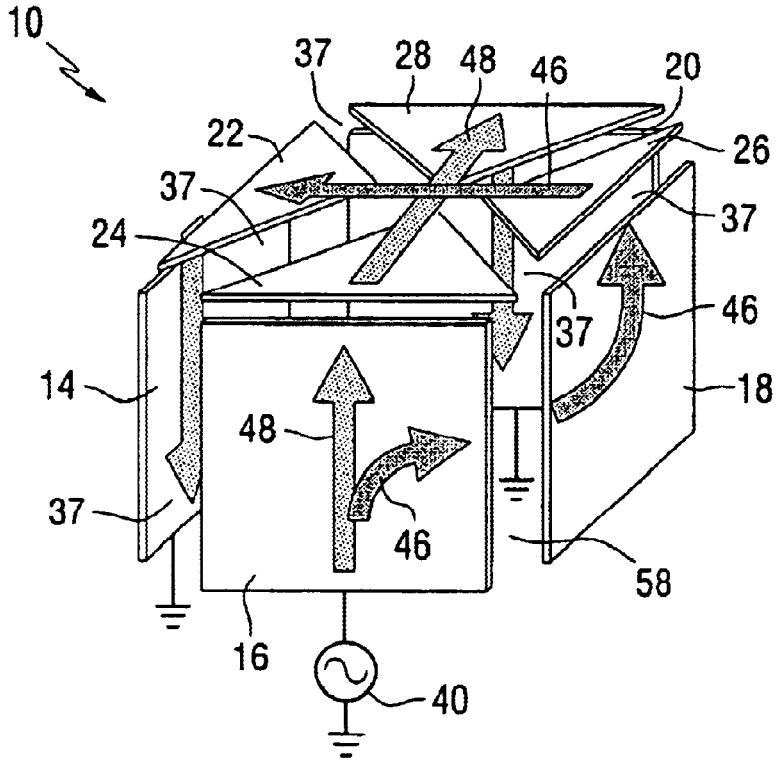
FIG. 6 illustrates current flow paths for a first configuration for the antenna of FIG. 3.

FIG. 6 illustrates connections for the various vertical panels and top panels for producing a left-hand circularly polarized signal. The vertical panel 16 is connected to a feed 40 and therefore a substantial current flows therein. The vertical panels 14 and 20 are connected to an antenna ground plane (not shown). The feed 40 is also connected to the antenna ground plane to complete the current flow path between the feed 40 and the grounded panels 14 and 20.

The capacitive coupling effect due to the proximity of adjacent panels forming the gaps 37 therebetween, causes current to flow between adjacent panels without the necessity for an electrical connection between the adjacent panels. Thus the coupling effect causes current flow from the vertical panel 16 to both the vertical panel 18 and the top panel 24, as indicated by the arrowheads 46 and 48. From the vertical panel 18, current flows into the top panel 26, through the conductive bridge 34, to the top panel 22 and to ground via the vertical panel 14.

Current also from the vertical panel 16 to the top panel 24, through the conductive bridge 36, the top panel 28 and the vertical panel 20 to ground. As a result of these two current flow paths, a left-hand circularly polarized signal is produced when the antenna 10 is operative in the transmitting mode. By analogy, the antenna 10, when configured as indicated in FIG. 6, is optimally responsive to left-hand circularly polarized received signals.

According to another embodiment, left-hand circular polarization can also be obtained when the feed and the ground panel connections are shifted to other vertical panels, so long as the relationship between the feed and ground connections is maintained. For example, the feed 40 can be connected to the panel 14 and the vertical panels 20 and 18 connected to ground.

Figure 7:
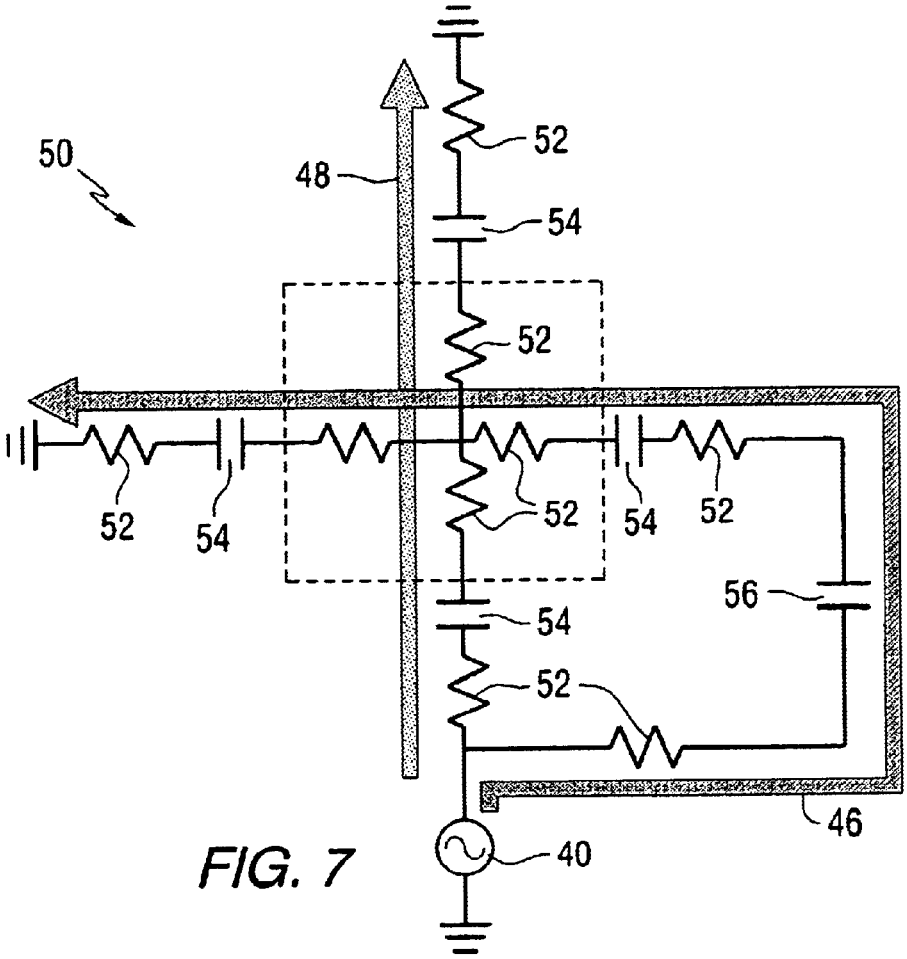
FIG. 7 illustrates an equivalent circuit for the antenna of FIG. 6.

FIG. 7 illustrates an equivalent circuit 50 for the antenna 10 configured as illustrated in FIG. 6. Each of the vertical and top panels is represented by a resistor 52 (and as is known, each of the panels exhibits inductance). The gap 37 between the various adjacent panels is indicated by a capacitor 54. The two current paths are illustrated by the arrowheads 46 and 48, each following the same path as indicated in FIG. 6.

In one embodiment, the antenna 10 further comprises a tuning capacitor 56 disposed between the vertical panel 16 and the vertical panel 18. For example, a gap 58 (see FIG. 6) between the vertical panels 16 and 18 comprises the tuning capacitor 56. As those skilled in the art recognize, the tuning capacitor 56 can be advantageously located between other adjacent panels in other embodiments of the present invention. In still another embodiment the tuning capacitor 56 comprises a discrete capacitive element not shown. In any case, the capacitance presented by the tuning capacitor 56 adjusts the capacitance of the current path and thus modifies the resonant characteristics of the antenna 10, as discussed further below. Adjustment of the capacitance of the tuning capacitor 56, by physical movement of one or both of the panels 16 and 18, by use or a piezoelectric device, for example, causes a change in the resonant frequency of the antenna 10.

With reference to the coordinate system of FIG. 5, the far-field expression for the electric field is given below. For a plane wave traveling in the z-direction, the currents flowing in the top panels 22, 24, 26 and 28 produce an electric field according to the following equations.

$$E_x(z;t)=E_{x0}\cos(\omega t+kz+\Phi_x);\quad \text{(x-component as a function of time)}$$

$$E_y(z;t)=E_{y0}\cos(\omega t+kz+\Phi_y);\quad \text{(y-component as a function of time)}$$

Where $E_{x0}$ and $E_{y0}$ are, respectively, the maximum magnitudes of the x and y components and $k=2\pi/\lambda$. Thus the time-phase difference between the x and y components is: $\Phi=\Phi_y-\Phi_x$. If the time phase difference is a multiple of $\pi$, i.e., $n\pi$, then the resulting wave is linearly polarized. A circularly polarized signal results when the magnitude of the two components are the same and the phase difference is an odd multiple of $\pi/2$.

Since the time-phase difference depends only on the phase difference in the two current paths, by adjusting the value of the tuning capacitor 56 of FIG. 7, a phase difference of $\Phi=\Phi_y-\Phi_x=-\pi/2$ can be realized. The resulting signal has a left-hand circularly polarized field rotation (also referred to as counter-clockwise field rotation).

Elliptical rotation patterns can also be obtained by appropriate gap adjustments to create a phase difference that is not equal to an odd multiple of $\pi/2$. Elliptical polarization is also obtained when the phase difference is an odd multiple of $\pi/2$ and the x and y component magnitudes are not equal.

Thus the antenna 10 can provide a circular, elliptical or linear polarized signal as a result of interactions between the current paths and the capacitance and inductance present in those current flow paths. The polarization is also a function of the angle $\theta$ from the zenith as certain currents may cancel at certain elevation angles.

Figure 8:
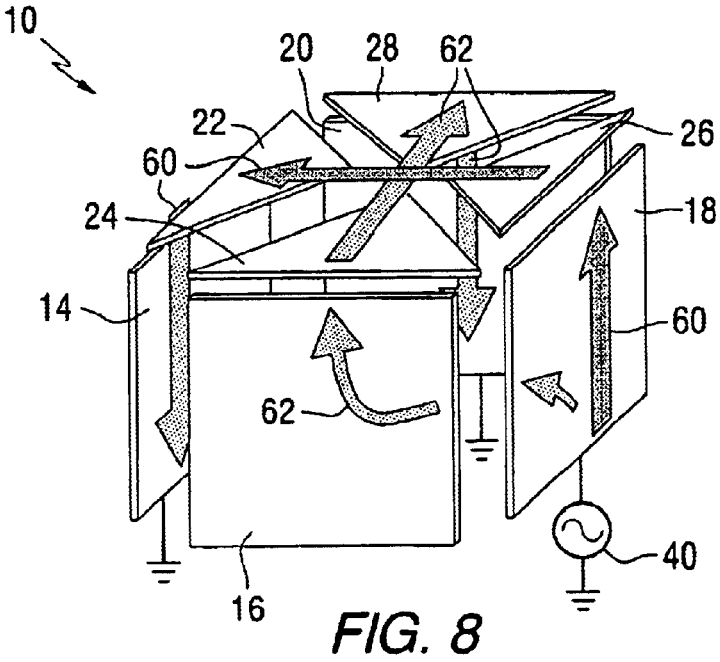
FIG. 8 illustrates current flow paths for a second configuration for the antenna of FIG. 3.

If the feed 40 is connected to the vertical panel 18 and the vertical panels 14 and 20 are grounded (the ground plane not illustrated), as illustrated in FIG. 8, the phase difference between the current flow paths is a multiple of $\pi/2$ (instead of a multiple of $-\pi/2$). Therefore, a right-hand circularly polarized signal is produced. The current flow paths are illustrated by arrowheads 60 and 62. Right hand circular polarization can also be obtained by shifting the feed and ground connections to other vertical panels while maintaining the orientation between the feed and ground connections.

Figure 9:
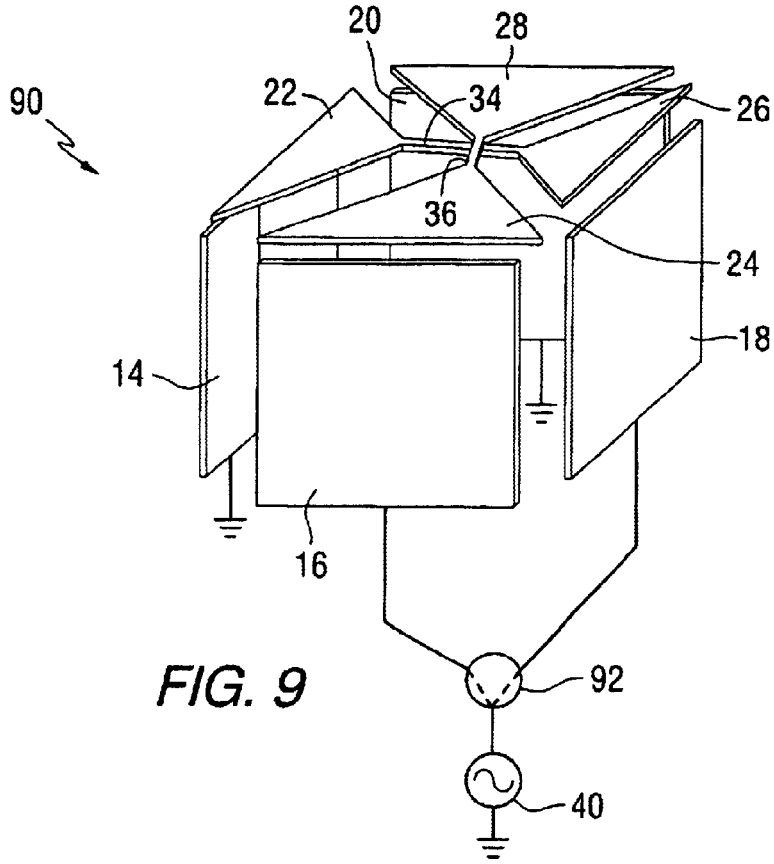
FIG. 9 illustrates a perspective view of another embodiment of an antenna constructed according to the teachings of the present invention.

FIG. 9 illustrates an antenna 90 capable of providing both left-hand circularly polarized signals and right-hand circularly polarized signals in response to a position of a switch 92 disposed between the vertical panels 16 and 18 and the feed 40 as shown. Thus, when current flows from the feed 40 to the vertical panel 16, the antenna signal is left-hand circularly polarized. When current flows from the feed 40 through the switch 92 to the vertical panel 18, the signal is right-hand circularly polarized.

Since the width of the gap 37 between the various vertical and top panels affects the antenna input impedance, the resonant frequency of the various antenna embodiments can be adjusted by controlling the gap dimensions. In particular, if the gaps are made larger, the resonant frequency increases and vice versa. The various antenna embodiments constructed according to the teachings of the present invention are resonant when the capacitive reactance presented by the gaps 37 between the various panels (and the tunable capacitance reactance 57 in the FIG. 7 embodiment) equals the inductive reactance of the panels. Under those conditions the current flow through the antenna elements is maximized, presenting a resonant condition.

In one embodiment, for an antenna constructed according to the teachings of the present invention to operate in a circular polarization mode (either right-hand or left-hand circular polarization), the electrical length of the each of the two current paths through the various panels must be approximately equal to a full wavelength at the operating frequency (referred to as the second resonance mode) to produce a current maxima in the region of the top plate, that is, in the region of the four top panels 22, 24, 26 and 28. Advantageously, the capacitance formed between adjacent panels due to the gap 37 provides a longer effective electrical length than the physical size of the antenna. For example, for operation at 2.3 GHz, a full wavelength is about 5.1". An antenna constructed according to the teachings of the present invention operating at this frequency can be formed on a cube wherein each side of the cube has a length of approximately 0.7". For such a cube, the physical length of the current path is 0.7×3=2.1". Operation in other resonance modes (where the current path is other than a full wavelength at the operating frequency) is possible by adjusting the panel dimensions (to change the inductance presented) and the gap dimensions (to change the capacitance presented). Typical gap dimensions are on the order of 0.04."

Figure 10:
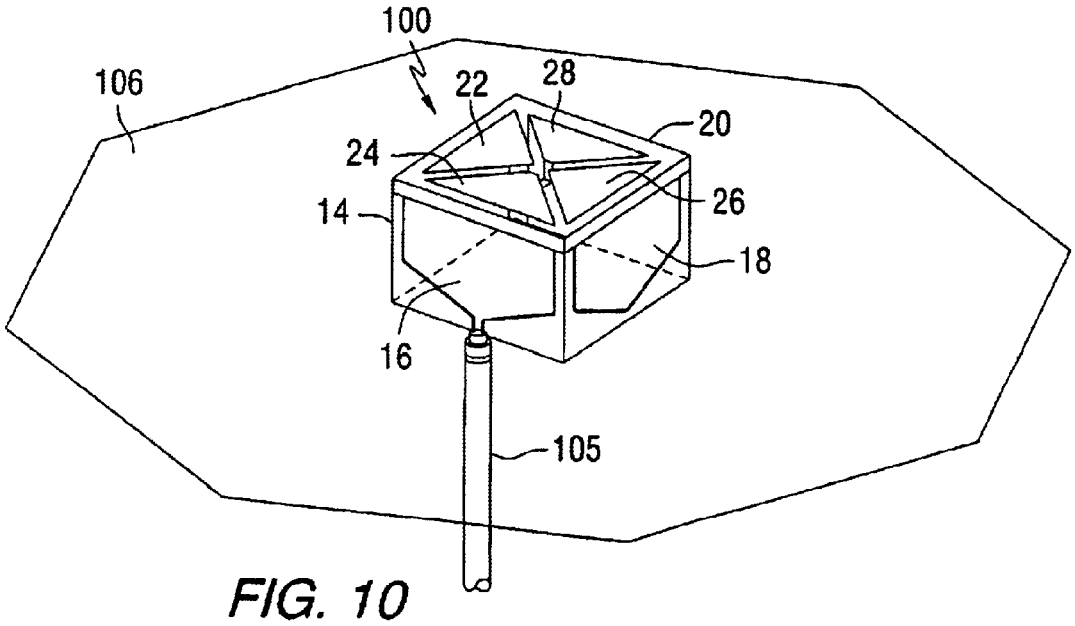
FIG. 10 illustrates a perspective view of yet another embodiment of an antenna constructed according to the teachings of the present invention.

In one embodiment, the various antenna panels can be formed from a dielectric substrate having a conductive cladding disposed thereon. The conductive cladding is patterned, masked and etched into the appropriate conductive panel shape, after which the substrates are affixed, for example, by gluing, into a cubic shape. Such an antenna 100 is illustrated in FIG. 10. The top panels 22, 24, 26 and 28 can be fabricated on a single printed circuit board substrate. Additionally, one of the conductive bridges 34 and 36 can be formed on the substrate. The second conductive bridge is implemented by, for example, a conductive wire connected between two of the opposing top panels. For example, if the conductive bridge 34 is formed by patterning and etching the conductive cladding material, the conductive bridge 36 is implemented by a conductive jumper wire connecting the top panels 24 and 28.

FIG. 10 also illustrates a ground plane 106 disposed below the antenna 100 for completing the electrical circuit between the feed and the grounded panels as shown in FIGS. 6, 8 and 9 as described above. The ground plane 106 can also provide a physical/mechanical structure for the vertical panels 16, 18, 20 and 22. The embodiment of FIG. 10 also illustrates a coaxial feed line 105 providing a signal to the vertical panel 16. Thus, the antenna 100 operates with left-hand circular polarization.

Figure 11:
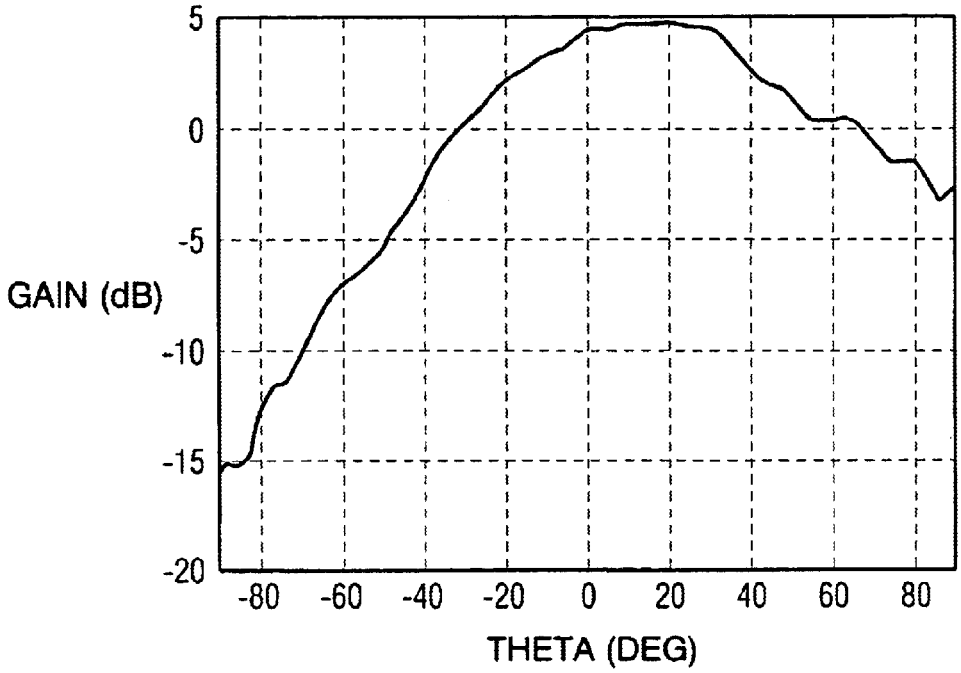
FIG. 11 is a radiation pattern graph of the antenna of FIG. 10.

As depicted in FIG. 11, the antenna 100 of FIG. 10 has a main beam along the z-axis according to the FIG. 5 coordinate system. FIG. 11 depicts gain on the vertical axis and the angle $\theta$ on the horizontal axis, and is thus referred to as an E-plane cut with $\Phi=0°$. As can be seen, the maximum gain is in the vicinity of $\theta=0°$. To reduce the energy toward the zenith and create a more omnidirectional-type pattern, the main beam energy must be lowered from the zenith toward the x-y plane. According to the teachings of the present invention, there are several techniques for accomplishing this objective.

Figure 12:
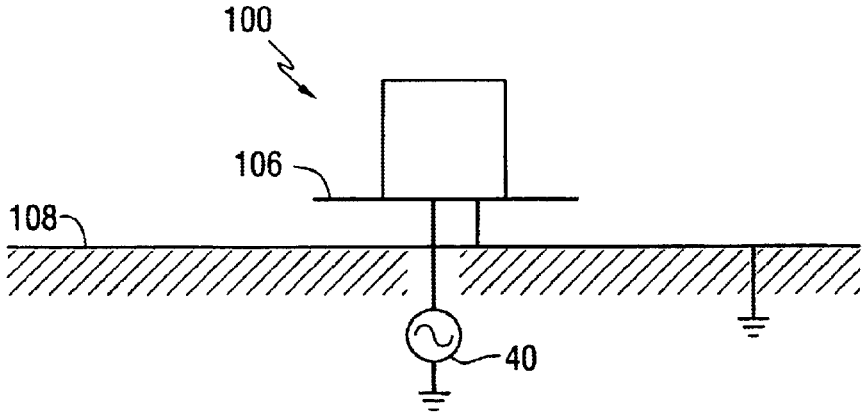
FIG. 12 illustrates an antenna constructed according to the teachings of the present invention disposed over a ground plane.

As illustrated in FIG. 12, the antenna 100 and the ground plane 106 are disposed over a ground plane 108. Either or both ground planes lowers the main beam energy and creates a more omnidirectional pattern. The total radiation is determined by the direct radiation from the antenna 100 and the reflected radiation from the image antenna formed by the ground plane 108. Thus the distance between the ground plane 108 and the antenna 100 creates a larger radiation field at a low radiation angle. The ground plane 108 represents, for example, the ground plane of a communications device in which the antenna 100 is mounted.

Figure 13:
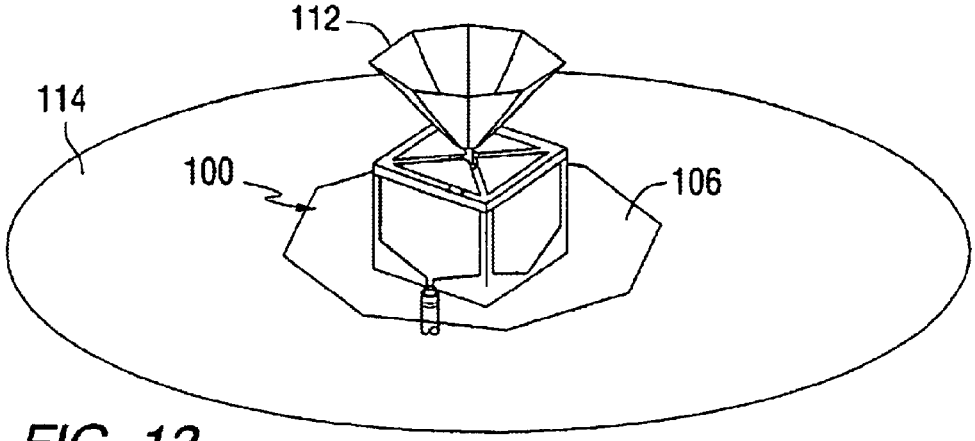
FIG. 13 illustrates a perspective view of another antenna constructed according to the teachings of the present invention.

According to another embodiment of the present invention, as illustrated in FIG. 13, placement of a cone-shaped reflector 112 above the antenna 100 also lowers the energy in the zenith direction, creating a radiation pattern that is more omnidirectional than the pattern of FIG. 11. The FIG. 13 embodiment also includes a ground plane 114 to also lower the radiation field pattern as described above in conjunction with the embodiment of FIG. 12.

Unsymmetrical current flow, as represented by current flow paths 60 and 62 of FIG. 8, for example, may be caused by variations in the various panel dimensions and the dimensions of the gaps between panels. For example, the current flowing on the top plates 22, 24, 26 and 28 may not be symmetrically distributed about the z-axis center line, causing an unbalanced omnidirectional radiation pattern when the antenna 100 is operated over a ground plane. To overcome the radiation pattern effects of these asymmetries, cones (such as the cone 112 of FIG. 13) of various shapes, sizes and asymmetries can be disposed above the top panels of the antenna 100, thus shifting the radiation in the z direction toward the xy plane and thereby producing a more balanced omnidirectional radiation pattern. A cone can also be located off the antenna vertical center line, i.e., the z-axis, to balance the radiation pattern.

Figure 14:
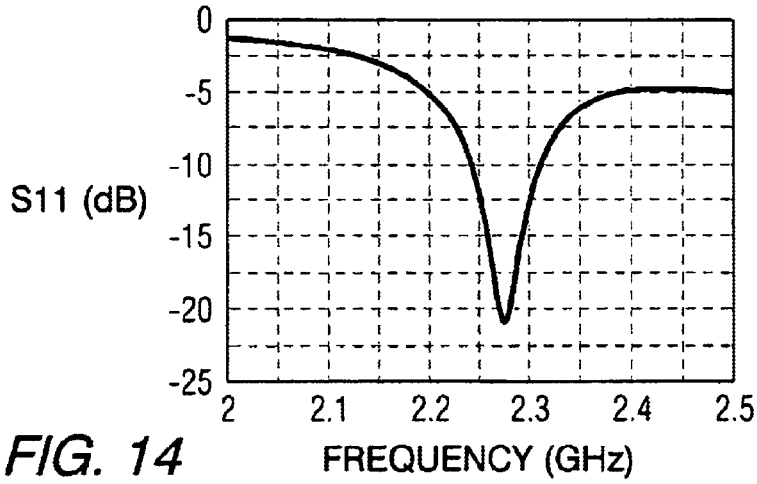
FIGS. 14 and 15 are graphs illustrating performance parameters for the antenna of FIG. 13.

FIG. 14 illustrates the input return loss for the antenna 100, including both a cone-shaped reflector 112 and a ground plane 108, i.e., the embodiment of FIG. 13. Using appropriately dimensioned vertical panels and top panels, and by appropriately sizing the gap between adjacent panels, the antenna displays a resonant frequency of about 2.28 GHz. A 1.2" diameter conductive cone is disposed about 0.04" above the plane of the top panels.

Figure 15:
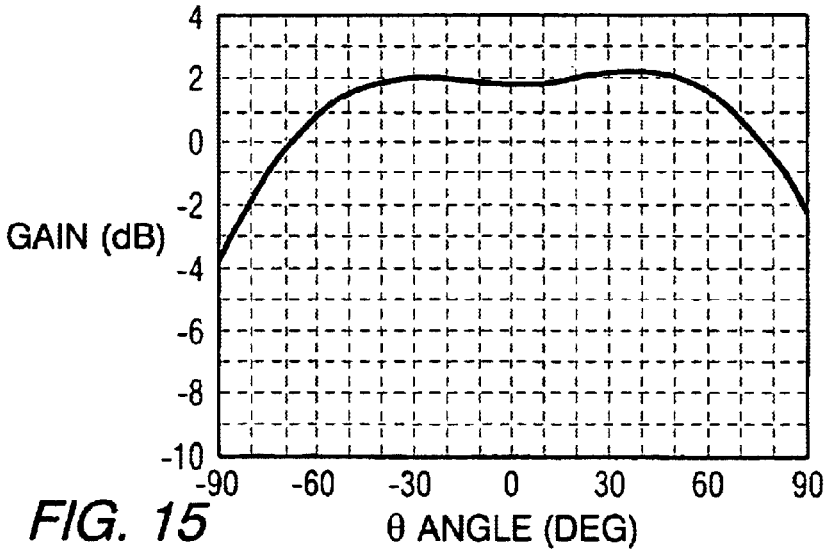

FIG. 15 illustrates the left-hand circular polarization radiation pattern for the FIG. 13 embodiment. As seen from the radiation pattern graph of FIG. 15, the antenna 100 so configured has an omnidirectional pattern. One objective in the FIG. 15 embodiment is to increase the gain in the near the horizon, i.e., about 20° to 30° above the horizon.

When the antenna 10 is operationally configured as illustrated in FIG. 8, the antenna 10 generates a right-hand circularly polarized signal directed primarily in the azimuth or z direction. The top panels 22, 24, 26 and 28 operate as crossed dipole antenna elements. If the vertical and horizontal panels of the antenna 10 and the gaps between panels are properly dimensioned, the antenna 10 operates at a global positioning system (GPS) frequency of about 1.575 GHz. As is known, the GPS satellite antennas operate with right-hand circular polarized signaling, and antenna radiation in the azimuth direction provides optimum signal strength for reception by a GPS satellite.

Figure 16:
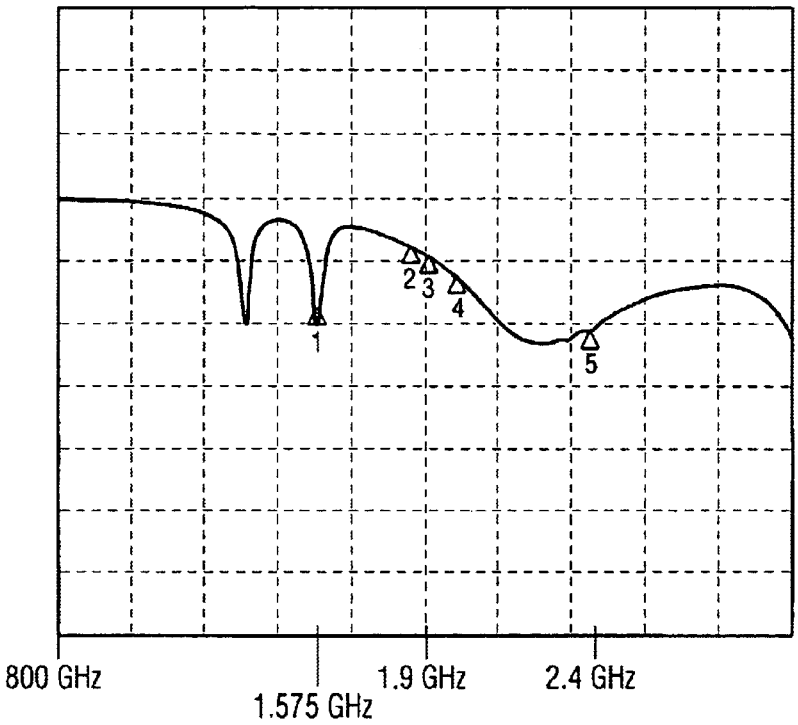
FIG. 16 is a return loss graph for the antenna of FIG. 8.

Advantageously, an antenna configured for GPS operation at 1.575 GHz also operates at the personal communication system (PCS) and Bluetooth wireless frequencies of about 1.9 GHz to about 2.4 GHz. At these frequencies, the antenna signal is linearly polarized and the pattern is substantially omnidirectional. FIG. 16 illustrates the return loss for an antenna operative at these three frequencies. The signal polarization, and the radiation pattern produced by an antenna constructed according to the present invention are dependent on the current path length and the capacitance and inductance in the current flow paths. Thus the antenna designer can crate a desired radiation pattern with a desired signal polarization in a desired region of free space by appropriately selecting the vertical and/or horizontal panel dimensions and the gap dimensions.

Thus the antenna 10 configured as illustrated in FIG. 8 operates in two different modes as a function of frequency, i.e., right-hand circularly polarized at 1.575 GHz and linearly polarized at 1.9 and 2.4 GHz. These operational characteristics apply both when the antenna 10 is transmitting and receiving. The input return loss measurements illustrating these two operational modes are shown in FIG. 16. Return loss, a function of frequency, is a common antenna figure of merit based on the ratio between the energy supplied to the antenna and the energy returning from the antenna back to the signal source. The higher the return loss, the greater portion of the energy supplied to the antenna that is radiated from the antenna. In an ideal case, the return loss is thus infinite. If the return loss is 1 (or 0 dB) the antenna does not radiate, as all the energy fed to it is returned back to the signal source.

In another embodiment of an antenna constructed according to the teachings of the present invention, the number of top panels and the number of vertical panels can be increased (or decreased) to alter the antenna characteristics, specifically to provide greater control over the currents flowing in the various panels through changing the panel inductance, and as a result, the antenna performance characteristics. For instance, increasing the number of vertical panels increases the current in the vertical plane and improves the signal strength for low-angle propagation, i.e., improves the omnidirectional pattern with more energy radiated along the x-y plane of the FIG. 5 coordinate system. Increasing the number of top panels and corresponding connective bridges adds cross dipole-type structures and improves the signal strength of the circularly polarized signal radiating in the zenith direction.

Figure 17:
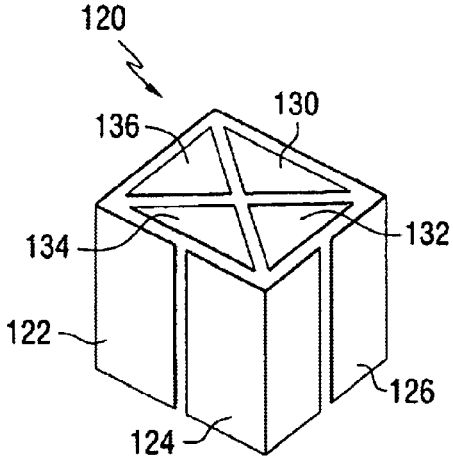
FIGS. 17–24 illustrate other antenna embodiments constructed according to the teachings of the present invention.

Another embodiment of the present invention comprising an antenna 120 is illustrated in FIG. 17 where the gaps between vertical panels 122, 124, 126 (the fourth vertical panel not visible in FIG. 17) have been shifted by 45° relative to the other embodiments described above. According to this embodiment, the vertical panels 122, 124, 126 and the fourth vertical panel not shown, are formed on a flexible dielectric substrate including a conductive clad layer disposed thereon. The conductive material is patterned, masked and etched to form the four panels and then shaped into an open ended cube. Top plates 130, 132, 134 and 136 can also be formed on a conductive clad dielectric substrate and affixed to the open ended cube structure. This technique and an antenna so constructed provides better dimension control over the gap dimensions since the gaps are formed by patterning, masking, and etching according to known lithographic techniques.

An antenna constructed according to the teachings of the present invention can also be formed in various additional configurations, as illustrated in FIGS. 18 through 24, including various exemplary techniques for attaching the top or horizontal panels to the vertical panels.

Figure 18:
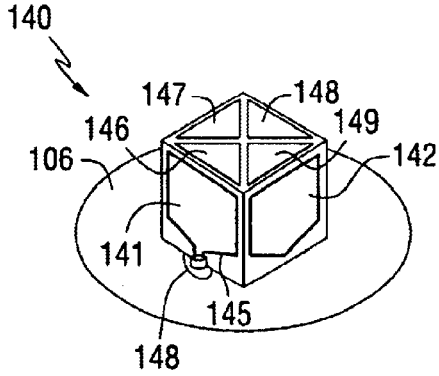

An antenna 140 of FIG. 18 comprises four vertical panels 141 and 142 (the others not visible in FIG. 18), each having a beveled bottom edge, such as an edge 145 of the vertical panel 142. The antenna 140 also comprises top panels 146, 147, 148 and 149. The beveled edge serves to increase the operational bandwidth above and below an antenna resonant frequency.

Figure 19:
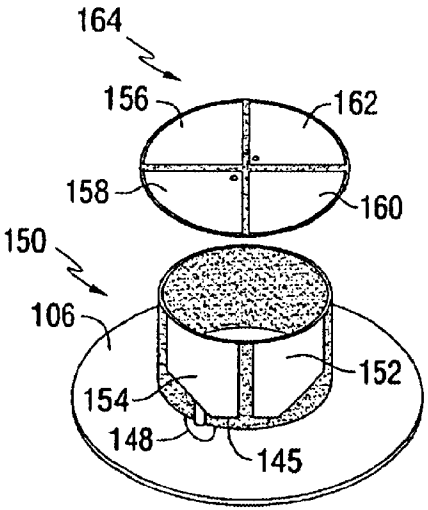

FIG. 19 illustrates a circular embodiment of an antenna 150 constructed according to the teachings of the present invention. The vertical panels 152 and 154 (the others not visible in FIG. 19) are formed by patterning and etching a flexible dielectric substrate 155 having a conductive layer disposed thereon. The substrate 155 is formed into the shape of a cylinder and abutting edges are joined. The antenna 150 further comprises four top panels 156, 158, 160 and 162 (connected by conductive bridges not shown but as described above in other embodiments of the present invention) formed on a dielectric substrate 164 by patterning, masking and etching a conductive material layer disposed thereon.

Figure 20:
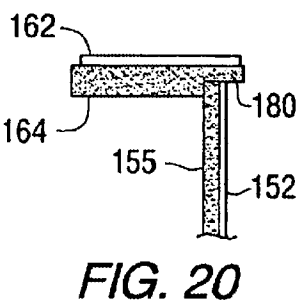

The dielectric substrate 164 is joined to the cylindrical substrate 155, by application of an adhesive, for example, to complete the antenna 150. FIG. 20 illustrates a joint between the dielectric substrate 164 and a vertical panel, such as the vertical panel 152, in the region of the top panel 162. An adjustable capacitive region 180 is formed by a gap between the vertical panel 152 and the top panel 162 as illustrated. Varying the capacitance presented by the adjustable capacitive region 180 impacts the antenna performance characteristics. As discussed above. Thus desired antenna characteristics can be achieved by the antenna designer by appropriately designing the gap forming the adjustable capacitive region.

An alignment feature is preferred to properly align the dielectric substrate 164 with the cylindrical substrate 155, that is to properly align the vertical panels 152 and 154 (and those not visible in FIG. 19) with the top panels 156, 158, 160 and 162. One such structure (not shown in FIGS. 19 and 20) comprises a key and tap arrangement, wherein a tab is positioned on an inner surface of the cylindrical substrate 155 for mating with an key positioned on a bottom surface of the dielectric substrate 164.

Figure 21:
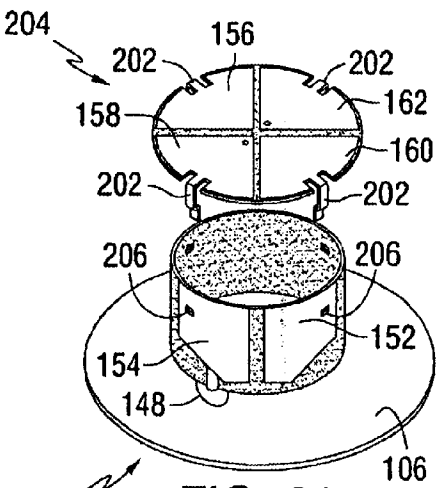
Figure 22:
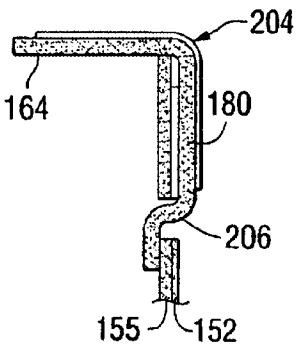

In another embodiment of an antenna 200 illustrated in FIGS. 21 and 22, each one of a plurality of downwardly-directed fingers 202 formed on a top plate 204 is received within one of a like plurality of slots 206 formed in the vertical panels 152 and 154 (the other vertical panels not shown in FIG. 21). Only two slots 206 are illustrated, although preferably each of the four vertical panels defines one slot therein. The top surface 204 comprises four top panels 156, 158, 160 and 162 (connected by conductive bridges not shown but as described above in other embodiments of the present invention) formed on the dielectric substrate 164 by patterning, masking and etching a conductive material layer disposed thereon. In the illustrated embodiment each one of the fingers 202 is contiguous with a respective top panel 156, 158, 160 and 162.

FIG. 22 illustrates one area of the antenna 200 in greater detail. As shown, one of the plurality of fingers 202 fits in a corresponding one of the plurality of slots 206. The capacitive region 180 is also illustrated.

Figure 23:
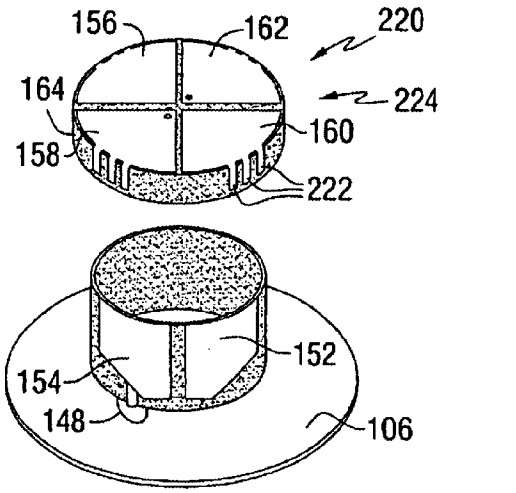
Figure 24:
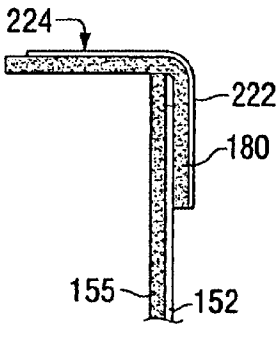

FIGS. 23 and 24 illustrate an embodiment of an antenna 220, comprising a plurality of fingers 222 extending downwardly from a top surface 224 on which are formed top panels 156, 158, 160 and 162 (connected by conductive bridges not shown but as described above in other embodiments of the present invention). In one embodiment the top surface 224 comprises the dielectric substrate 164 with the fingers 222 disposed about the circumference thereof. The top panels 156, 158, 160 and 162 are formed thereon by patterning, masking and etching a conductive material layer disposed on the dielectric substrate 164. A thickness of the dielectric substrate 164 controls the dimensional stability of the panels formed thereon, such that a thicker dielectric substrate 164 provides greater dimensional stability.

In another embodiment the fingers 222 can be interdigitated with corresponding fingers on the dielectric substrate 155 to for the gap capacitance.

FIG. 24 illustrates the interconnection between the top surface 224 and the dielectric substrate 155. Those skilled in the art recognize that various techniques can be used to bond the top surface 224 to the dielectric substrate 155. An alignment feature, such as discussed in conjunction with FIGS. 19 and 20 is preferably employed with the embodiment of FIGS. 23 and 24.

The advantages of the various antenna embodiments constructed according to the teachings of the present invention can now be appreciated. The various embodiments are compact, in one embodiment the antenna forming a cube having a width of 0.14λ by a length of 0.14λ by a height of 0.14 λ. Thus the antenna size is proportional to the operative frequency wavelength, with a multiple of 0.14. No phase shifting components are required as is common in the prior art, (for example, no quadriture hybrid phase shifters are employed) as circular polarization is created due to the current flow directions within the antenna elements.

In one embodiment, the antenna radiation efficiency is about 78%. As described above, it is relatively easy to change between left-hand and right-hand circular polarizations through the use of a switch. Also, radiation or beam pattern control is adjustable by placing a reflector (for example, a cone reflector) above the antenna or spacing the antenna off center relative to an underlying ground plane. Thus, the beam pattern can be modified from one that is primarily directional in the azimuth or z direction to one that is relatively omnidirectional. These beam pattern changes are accomplished without affecting the circular polarization.

In one embodiment, the antenna operates at 2.3 GHz with the various panels formed on a cube (or other polyhedron, including a regular polyhedron) having dimensions of 0.7"× 0.7"×0.7". At 2.3 GHz these dimensions are approximately 0.14λ. The bandwidth of an antenna so constructed is about 80 MHz at 2.3 GHz, where the bandwidth is defined as the region where the voltage standing wave ratio is less than about 2:1. In this embodiment, the antenna efficiency is about 78%. The antenna gain is about 5 dBic for a left-hand circular polarization directional pattern and about 2.3 dBic for a left-hand circularly polarized omnidirectional pattern.

In certain embodiments, it is not required that the various vertical panels described above all have the same length. Also, it is not required that all gaps between adjacent vertical panels, between adjacent horizontal panels and between vertical and horizontal panels be of the same dimension. Such gap and panel variations and asymmetries are considered within the scope of the present invention. Additionally, in another embodiment the top panels can be extended over an edge of the top surface downwardly onto a side surface of the antenna, such that the gap is disposed on the side surface between a vertical panel disposed thereon and the top panel extending downwardly onto the side surface.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a plurality of vertical conductive surfaces each having a top edge, the plurality of vertical surfaces oriented to form side surfaces of an upright structure with a first gap defined between adjacent vertical surfaces;

a plurality of horizontal conductive surfaces forming a top surface of the upright structure, the plurality of horizontal surfaces oriented to form a second gap between adjacent horizontal surfaces;

third gaps formed between a top edge of each one of the plurality of vertical surfaces and an adjacent one of the plurality of horizontal surfaces;

a first conductive bridge electrically connecting a first and a second horizontal surface of the plurality of horizontal surfaces;

a second conductive bridge electrically connecting a third and a fourth horizontal surface of the plurality of horizontal surfaces;

a first vertical surface of the plurality of vertical surfaces for connecting to a signal feed for the antenna; and a second and a third vertical surface of the plurality of vertical surfaces for connecting to ground.

2. The antenna of claim 1 wherein the plurality of vertical surfaces comprises four rectangular vertical surfaces and the upright structure comprises a rectangular regular polyhedron.

3. The antenna of claim 1 wherein the plurality of vertical surfaces comprises four square vertical surfaces, and wherein the upright structure comprises a cube.

4. The antenna of claim 1 wherein the plurality of horizontal surfaces comprises four triangular surfaces.

5. The antenna of claim 1 wherein the first, second and third vertical surfaces are selected to provide left hand circular polarization for a signal transmitted by the antenna.

6. The antenna of claim 1 wherein the first, second and third vertical surfaces are selected to provide right hand circular polarization for a signal transmitted by the antenna.

7. The antenna of claim 1 further comprising a switch for selecting one of the first, second, third and fourth vertical surfaces as the signal feed for the antenna.

8. The antenna of claim 1 further comprising a ground plane disposed below the antenna.

9. The antenna of claim 8 wherein a position of the ground plane is selected to affect a radiation pattern of the antenna.

10. The antenna of claim 8 wherein one or more of the first, second, third and fourth vertical surfaces are affixed to the ground plane.

11. The antenna of claim 1 further comprising a reflective surface disposed above the antenna.

12. The antenna of claim 11 wherein the reflective surface comprises a cone-shaped reflective surface.

13. The antenna of claim 11 wherein a position of the reflective surface relative to the antenna is selected to affect a radiation pattern of the antenna.

14. The antenna of claim 1 wherein the plurality of vertical surfaces is equal in number to the plurality of horizontal surfaces, and wherein each one of the plurality of horizontal surfaces is disposed adjacent a top edge of each one of the plurality of vertical surfaces, defining the third gap therebetween.

15. The antenna of claim 1 wherein the first, second and third gaps provide capacitive coupling between adjacent surfaces defining the gap.

16. The antenna of claim 1 wherein dimensions of the first, second and third gaps are selected to provide desired performance characteristics for the antenna.

17. The antenna of claim 1 wherein the bottom edge of each of the plurality of vertical surfaces comprises a beveled bottom edge.

18. The antenna of claim 1 wherein the plurality of vertical surfaces comprises four substantially rectangular vertical surfaces and the upright structure comprises a cylinder.

19. The antenna of claim 1 wherein the dimensions of each one of the plurality of vertical surfaces and the dimensions of each one of the plurality of horizontal surfaces are selected to provide desired antenna performance characteristics.

20. The antenna of claim 1 having a resonant frequency determined by the capacitance presented by the first, second and third gaps, the dimensions of each one of the plurality of vertical surfaces and the dimensions of each one of the plurality of horizontal surfaces.

21. The antenna of claim 1 further comprising a tuning capacitor for determining a resonant frequency of the antenna.

22. The antenna of claim 1 wherein the first vertical surface comprises a bottom edge, and wherein the bottom edge is connected to the signal feed.

23. The antenna of claim 1 wherein the second and the third vertical surfaces each comprise a bottom edge and wherein the bottom edge of each of the second and the third vertical surfaces is connected to ground.

24. The antenna of claim 1 further comprising current flow paths through the plurality of vertical surfaces and the plurality of horizontal surfaces from the signal feed to ground, wherein a capacitance and an inductance in the current flow paths determines antenna performance characteristics.

25. The antenna of claim 24 wherein the first, second and third gaps create the capacitance in the current flow paths.

26. The antenna of claim 24 further comprising a tuning capacitor to create capacitance in one or more of the current flow paths.

27. The antenna of claim 24 wherein dimensions of the plurality of vertical surfaces and the plurality of horizontal surfaces create the inductance in the current flow paths.

28. An antenna comprising:

a first, a second, a third and a fourth conductive surface each vertically oriented to form a side face of a rectangular regular polyhedron with first gaps defined between adjacent surfaces, each one of the first, second, third and fourth surfaces comprising a top edge and a bottom edge;

a fifth, a sixth, a seventh and an eighth triangular conductive surface each having a base and an apex and each disposed in a plane forming a top face of the polyhedron with the apex directed toward a center region of the top face, wherein second gaps are formed between adjacent ones of the fifth, sixth, seventh and eighth triangular surfaces;

wherein third gaps are formed between the top edge of each one of the first, second, third and fourth surfaces and a proximate base of one of the fifth, sixth, seventh and eighth triangular surfaces;

a first conductive bridge electrically connecting a fifth and a sixth triangular surface, wherein the fifth and the sixth triangular surfaces are opposingly directed on the top face;

a second conductive bridge electrically connecting a seventh and an eighth triangular surface, wherein the seventh and the eighth triangular surfaces are opposingly directed on the top face;

a bottom edge of the first surface for connecting to a signal feed; and a bottom edge of the second and the third surfaces for connecting to ground.

29. The antenna of claim 28 wherein the polyhedron comprises a cube.

30. The antenna of claim 28 wherein each one of the first, second, third and fourth rectangular surfaces is disposed on a dielectric substrate.

31. The antenna of claim 28 wherein the fifth, sixth, seventh and eighth triangular surfaces are disposed on a dielectric substrate.

32. An antenna comprising:

a first, a second, a third and a fourth conductive surface disposed on a flexible dielectric substrate having first gaps defined between adjacent surfaces, each one of the first, second, third and fourth surfaces comprising a top edge and a bottom edge;

the substrate forming a cylinder with the first, second, third and fourth surfaces disposed vertically thereon;

a fifth, a sixth, a seventh and an eighth triangular conductive surface each having a base and an apex and each disposed in a plane forming a top surface of the cylinder with each apex directed toward a center region of the top surface, wherein second gaps are defined between adjacent ones of the fifth, sixth, seventh and eighth triangular surfaces;

wherein third gaps are formed between the top edge of each one of the first, second, third and fourth surfaces and a proximate base of one of the fifth, sixth, seventh and eighth triangular surfaces;

a first conductive bridge electrically connecting a fifth and a sixth triangular surface, wherein the fifth and the sixth triangular surfaces are opposingly disposed on the top surface;

a second conductive bridge electrically connecting a seventh and an eighth triangular surface, wherein the seventh and the eighth triangular surfaces are opposingly disposed on the top surface;

a bottom edge of the first surface for connecting to a signal feed; and a bottom edge of the second and the third surfaces for connecting to ground.

* * * * *